US006581898B2

(12) United States Patent
McCracken

(10) Patent No.: US 6,581,898 B2
(45) Date of Patent: Jun. 24, 2003

(54) BEARING BLOCK FOR ALIGNMENT AND HANDLING OF CONCRETE FORMS

(75) Inventor: Robert McCracken, Urbandale, IA (US)

(73) Assignee: Wilian Holding Company, Des Moines, IL (US)

( * ) Notice: Subject to any disclaimer, the term of this patent is extended or adjusted under 35 U.S.C. 154(b) by 0 days.

(21) Appl. No.: 09/792,746

(22) Filed: Feb. 23, 2001

(65) Prior Publication Data

US 2002/0117603 A1 Aug. 29, 2002

(51) Int. Cl.[7] ..... E04G 9/06; E04G 17/04

(52) U.S. Cl. ..... 249/189; 249/44; 249/47; 52/584.1

(58) Field of Search ..... 249/189, 191, 249/192, 196, 44, 45, 47; 52/585.1, 584.1, 582.2

(56) References Cited

U.S. PATENT DOCUMENTS

| | | | | | |
|---|---|---|---|---|---|
| 2,702,422 | A | * | 2/1955 | Symons | 249/45 |
| 2,715,257 | A | * | 8/1955 | Symons | 249/45 |
| 2,816,345 | A | * | 12/1957 | Symons | 249/191 |
| 2,963,763 | A | * | 12/1960 | Le Cluyse | 249/189 X |
| 3,015,144 | A | * | 1/1962 | Leonard | 249/196 |
| 3,899,155 | A | * | 8/1975 | Ward | 249/189 |
| 4,915,345 | A | * | 4/1990 | Lehmann | 249/44 X |
| 4,957,272 | A | * | 9/1990 | Lee | 249/196 |

FOREIGN PATENT DOCUMENTS

| | | | | |
|---|---|---|---|---|
| DE | 4122173 | * | 1/1993 | 249/189 |
| EP | 062420 | * | 10/1982 | 249/44 |

* cited by examiner

*Primary Examiner*—Laura A. Callo
(74) *Attorney, Agent, or Firm*—Kent A. Herink; Daniel A. Rosenberg; Davis Law Firm

(57) ABSTRACT

Modular concrete form components which, when assembled into large wall form assemblies are sufficiently strong to resist the bending forces applied during picking and placing of the wall form assemblies without the need for the attachment of additional or external stiffening members. A bearing block is secured to a stiffener that runs along the back side of the form component adjacent a perimeter flange of the form component.

5 Claims, 3 Drawing Sheets

BEARING BLOCK FOR ALIGNMENT AND HANDLING OF CONCRETE FORMS

BACKGROUND OF THE INVENTION

1. Field of the Invention

The invention relates generally to apparatus used in forming concrete structures and, more specifically, to a bearing block that is attached to a modular concrete form to assist in aligning form components and in handling assemblies of forms.

2. Background of the Prior Art

Concrete forming apparatus is in wide use in the construction of buildings, bridges, and other concrete structures. A common system for forming concrete structures uses a plurality of modular form components that are adapted to be assembled into a wide variety of configurations to conform to virtually any architectural requirement. Such forming apparatus components are typically made of metal so that they are strong enough to support the heavy weight of poured concrete and durable so that the components can be reused many times.

One of the most commonly used configurations of such metal form components is a flat panel that is used in forming substantially flat concrete surfaces, such as walls, foundations, pillars, and the like. In current practice, the modular wall forms are assembled face down on a horizontal surface into large wall form assemblies. These assemblies must then be moved from the horizontal, assembly position into a typically vertical, working position. Most commonly, a crane is attached to the end portion of the assembly that is to be at the top when moved to its working position. The action of lifting the form assembly elevates the top end of the form assembly while the bottom end remains in contact with the horizontal surface on which it was assembled. Accordingly, there are large bending forces that are applied to the form assembly. Wall form assemblies are typically of a size that these forces are greater than what can be withstood by the connections between the modular form components. As a result, some external stiffening members, such as beams, are added to the back side of the form assembly to allow it to be picked and placed without damage to the form assembly. These stiffening members, however, are not required to support or stiffen the form assembly once it is in place and while it is being used in the formation of a poured concrete wall section. Time is spent attaching the stiffening members and additional cost is involved in the expense of stocking additional inventory of components.

While the modular form components could be made out of heavier material, for example thicker steel, so that they would resist the imposed bending forces when assembled into large form assemblies, the resulting forms would be "over-engineered" for their primary function of forming concrete walls, would be more expensive to manufacture, more expensive to deliver to construction sites and require larger, more expensive equipment to transport at the construction site.

There is a need for modular concrete forming components that can be assembled into large wall form assemblies that are sufficiently strong to resist the bending forces applied during picking and placing of the wall form assemblies without the need for the attachment of additional or external stiffening members.

SUMMARY OF THE INVENTION

The invention consists of a modular concrete form component that has a bearing block secured to the form component. The form component consists of a face sheet on the back of which are arranged a plurality of spaced apart ribs and at least two spaced apart transverse stiffeners. A rearwardly extended flange extends around the perimeter of the face sheet. A bearing block is secured to the stiffeners at the intersection of the stiffeners with the perimeter flange. Assemblies of the form components include connections, such as with nut and bolt combinations, made through bearing blocks of adjacent form components. The additional strength and positioning of the bearing blocks adds sufficient stiffness to assemblies of the form components to allow them to resist bending forces imposed during picking and placing of the form assembly without unduly increasing the cost or weight of the form components.

An object of the present invention is to provide a concrete form component that includes a bearing block which provides sufficient additional stiffness in assembly with other such form components to resist bending forces during picking and placing of large assemblies of the form components without the use of additional or external stiffening members.

Another object of the invention is to provide a concrete form component that resists bending forces when assembled into large form assemblies without substantial additional weight or cost of manufacture.

These and other objects of the invention will be made apparent to those skilled in the art upon a review and understanding of this specification, the associated drawings, and the appended claims.

DETAILED DESCRIPTION OF PREFERRED EMBODIMENTS

Figure 1:
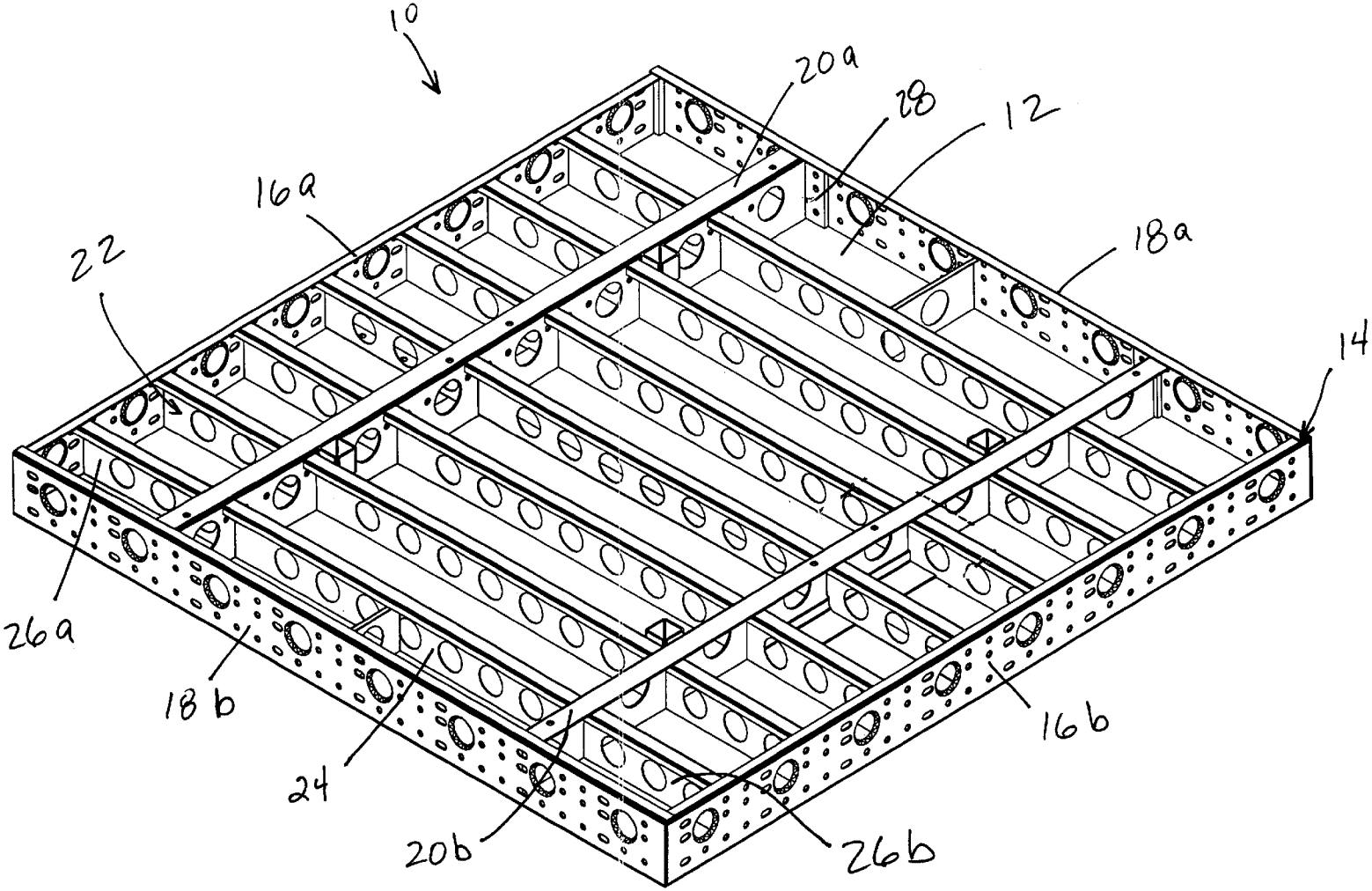
FIG. 1 is a perspective view of a modular concrete form component of the present invention.

Referring to the drawings, there is illustrated in FIG. 1, generally at 10, a metal concrete form panel of the present invention. The form panel includes a face sheet 12 on its front surface and a rearwardly extended flange 14 that extends around the perimeter of the face sheet, including a pair of opposing end rails 16*a* and 16*b* and a pair of opposing side rails 18*a* and 18*b*. The flange 14 is secured to the face sheet 12 by weldments or the like.

In a preferred embodiment, a pair of stiffeners, referred to as tie ribs 20*a* and 20*b*, extend between the side rails 18*a* and 18*b* and are secured by weldments or the like to the back side of the face sheet 12. A plurality of cross ribs 22 are arranged on the back side of the face sheet 12, extended between the end rails 16*a* and 16*b*. In the preferred embodiment, each of the cross ribs 22 includes a central, cross rib section 24 and a pair of cross rib end sections 26*a* and 26*b*. The sections 24, 26*a* and 26*b* are secured to the back side of the face sheet 12 by weldments or the like.

Figure 2:
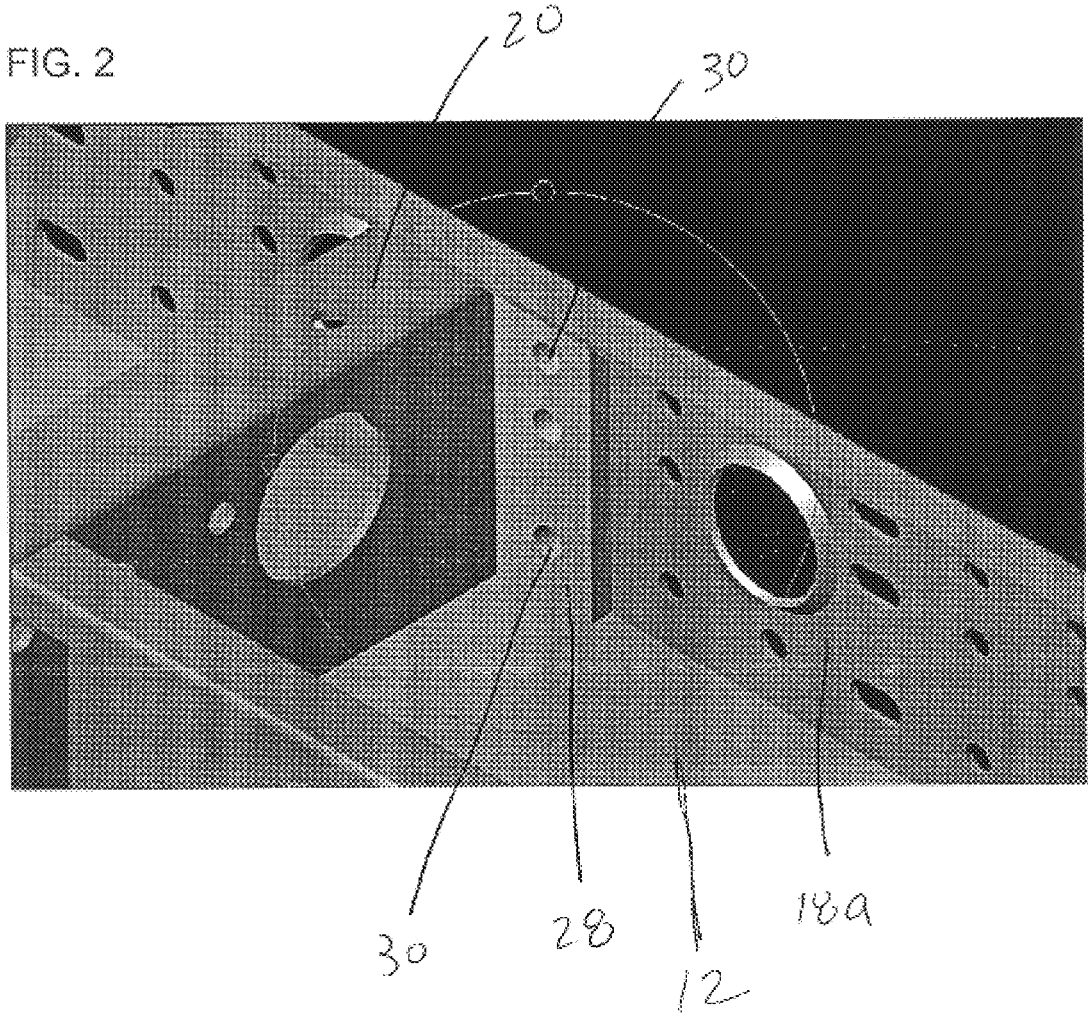
FIG. 2 is an enlarge perspective view of a bearing block secured to the form component.
Figure 3:
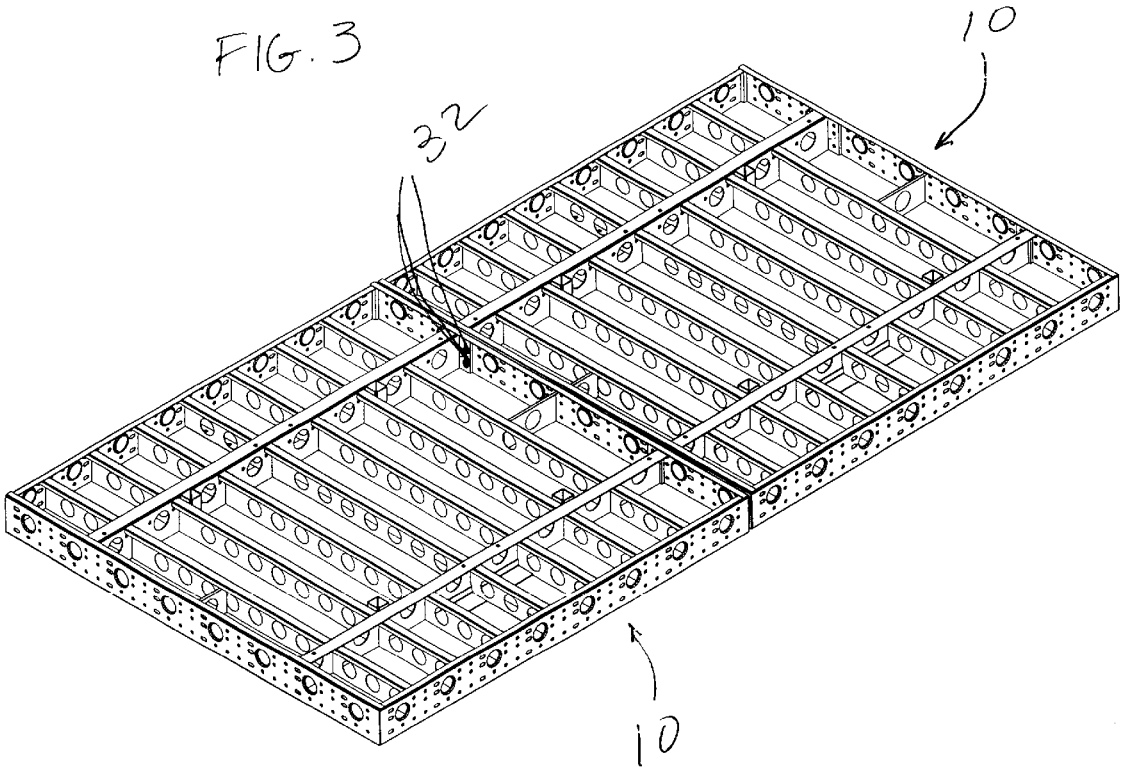
FIG. 3 is a perspective view of two form components of the present invention interconnected to create a form assembly.

A bearing block 28 is secured by weldments or the like to each end of the tie ribs 20*a* and 20*b* at the intersection of the tie ribs 20 with the side rails 18*a* and 18*b* (FIG. 2). The bearing blocks 28 are perforated by a number of holes 30 that are aligned with corresponding holes in the side rails 18. To assemble two of the form panels 10 together to make a form assembly, two of the panels are placed with their face sheets on a horizontal surface and oriented so that end rails of the two panels and in contact engagement. The form panels are then adjusted so that corresponding holes of the pair of bearing blocks are aligned and a releasable connector, such as a nut and bolt combination 32, is inserted into the aligned holes and tightened to join the two form panels together (FIG. 3).

The form panels can be of any size desired for use in the concrete forming industry. In a preferred embodiment the form panel 10 is 8 feet square. There are two tie ribs 20*a* and 20*b* that are spaced inwardly of the end rails 16*a* and 16*b*, respectively, by one foot, ten and one-half inches. There are seven cross ribs 22, one of which is located in the middle of the form panel 10 midway of the side rails 18 and the other six of which are spaced equidistant of the central cross rib 22, with three each on either side. The tie ribs 20 are formed of one-quarter inch plate A570 Grade 50 steel. The cross ribs 22 are made of one-eighths inch sheet A607 Grade 50 steel. The rails 14 and 16 and the face sheet 12 are made of one-quarter inch plate A570 Grade 50 steel. The bearing blocks are made of five-eighths inch A36 steel.

If a form panel is constructed as described above, but without bearing blocks of the present invention, only a single panel (8 feet tall) can be lifted without requiring the use of walers or similar external stiffeners being applied to the assembly of forms to prevent it from deforming when picked from one end, as by a crane. In contrast, if bearing blocks 28 of the present invention are employed, four form panels 10 can be assembled end-to-end (32 feet tall) and picked by one end without causing deformation of the form panel assembly.

Although the invention has been described with respect to a preferred embodiment thereof, it is to be also understood that it is not to be so limited since changes and modifications can be made therein which are within the full intended scope of this invention as defined by the appended claims.

I claim:

1. A modular concrete form component, comprising:

(a) a face sheet having a side portion;

(b) a flange extended rearwardly of the face sheet along the side portion with a longitudinal and transverse axis;

(c) at least two stiffeners arranged on the back side of the face sheet and transverse to the flange with a longitudinal and transverse axis; and (d) a bearing block corresponding to each of the stiffeners, the bearing block having a longitudinal axis the same as the transverse axes of both the stiffener and the flange, wherein the bearing block bears against substantially the entire transverse axes of both the stiffener and the flange and is secured to the flange and fitted against the stiffener.

2. A concrete form assembly, comprising at least two concrete form components as defined in claim 1 with the flanges of each form component in contact engagement and releasably interconnected by a plurality of connectors which engage adjacent bearing blocks of the form components to provide sufficient additional stiffness to the concrete form assembly to resist bending forces imposed when one end of the form assembly is supported above an opposite end of the form assembly.

3. The modular concrete form component as defined in claim 1, wherein the transverse axis of the stiffener is substantially the same length as the transverse axis of the flange.

4. A modular concrete form component, comprising:

(a) a rectangular face sheet:

(b) a flange extended rearwardly of the face sheet around the perimeter of the face sheet with a longitudinal and transverse axis:

(c) at least two space apart stiffeners arranged on the back side of the face sheet and transverse to opposing sections of the flange with a longitudinal and transverse axis; and (d) a bearing block corresponding to each of the stiffeners, the bearing block having a longitudinal axis the same as the transverse axes of both the stiffener and the flange, wherein the bearing block bears against substantially the entire transverse axes of both the stiffener and the flange and is secured to the flange and fitted against the stiffener.

5. The modular concrete form component as defined in claim 4, wherein the transverse axis of the stiffener is substantially the same length as the transverse axis of the flange.

* * * * *